US005491911A

United States Patent [19]

Chen

[11] Patent Number: 5,491,911

[45] Date of Patent: Feb. 20, 1996

[54] FASTENING MEANS TO SECURE A GAITER TO A SHOE

[75] Inventor: Ting-Hsing Chen, Tainan, Taiwan

[73] Assignee: Far Great Plastics Industrial Co., Ltd., Tainan, Taiwan

[21] Appl. No.: 374,116

[22] Filed: Jan. 18, 1995

[51] Int. Cl.[6] ..... A43B 7/20

[52] U.S. Cl. ..... 36/89; 36/115

[58] Field of Search ..... 36/115, 89, 1.5, 36/101, 50.1, 50.5, 88, 109, 114, 117, 118, 132; 24/68 SK, 71 SK, 69 SK, 70 SK

[56] References Cited

U.S. PATENT DOCUMENTS 4,107,856 8/1978 Bourque ..... 36/115
4,126,323 11/1978 Scherz ..... 36/115
5,327,620 7/1994 Chen ..... 36/50.1

FOREIGN PATENT DOCUMENTS 1066501 11/1979 Canada ..... 36/115

*Primary Examiner*—Thomas P. Hilliard
*Attorney, Agent, or Firm*—Morton J. Rosenberg; David I. Klein

[57] ABSTRACT

A fastening system to secure a gaiter to a shoe is provided. The fastening system includes a shoe having a pair of studs integrally formed at the rear end thereof and a gaiter having at least three apertures on the rear end thereof. A belt is also included with an aperture formed at a center portion and having one end secured to a fastener disposed at one side of the gaiter, the other end of the belt being inserted through an aperture of a buckle formed in an opposing side of the gaiter and releasably coupled to the fastener to hold the gaiter securely in place.

1 Claim, 3 Drawing Sheets

FASTENING MEANS TO SECURE A GAITER TO A SHOE

FIELD OF THE INVENTION

This invention relates to a fastening means and more particularly to a fastening means to secure a gaiter to a shoe.

BACKGROUND OF THE INVENTION

The fastening means to connect a gaiter to a shoe or to a roller skate has been invented in a various types. One of which is an invention of the applicant and was patented by the U.S. Patent and Trademark Office with a U.S. Pat. No. 5,327,620. This invention includes a roller skate having buckle integrally formed to the rear end thereof, and a gaiter having a pair of apertures at the rear end and a fasten belt. The buckle includes a lateral hole which is adapted for the fasten belt to insert and to pass therethrough and to be secured by a fastener. This will secure the gaiter to the roller skate or the shoe. However, such connection is merely a two-point connection, the fastener and the buckle and may be shifted its position.

SUMMARY OF THE INVENTION

It is the primary object of the present invention to provide a fastening means to secure a gaiter to a shoe which utilizes three-point connection to secure the gaiter to the shoe.

It is an other object of the present invention to provide a fastening means to secure a gaiter to a shoe which is easy to operate.

It is a further object of the present invention to provide a fastening means to secure a gaiter to a shoe which is inexpensive in manufacture.

DETAILED DESCRIPTION OF THE PREFERRED EMBODIMENT

Figure 1:
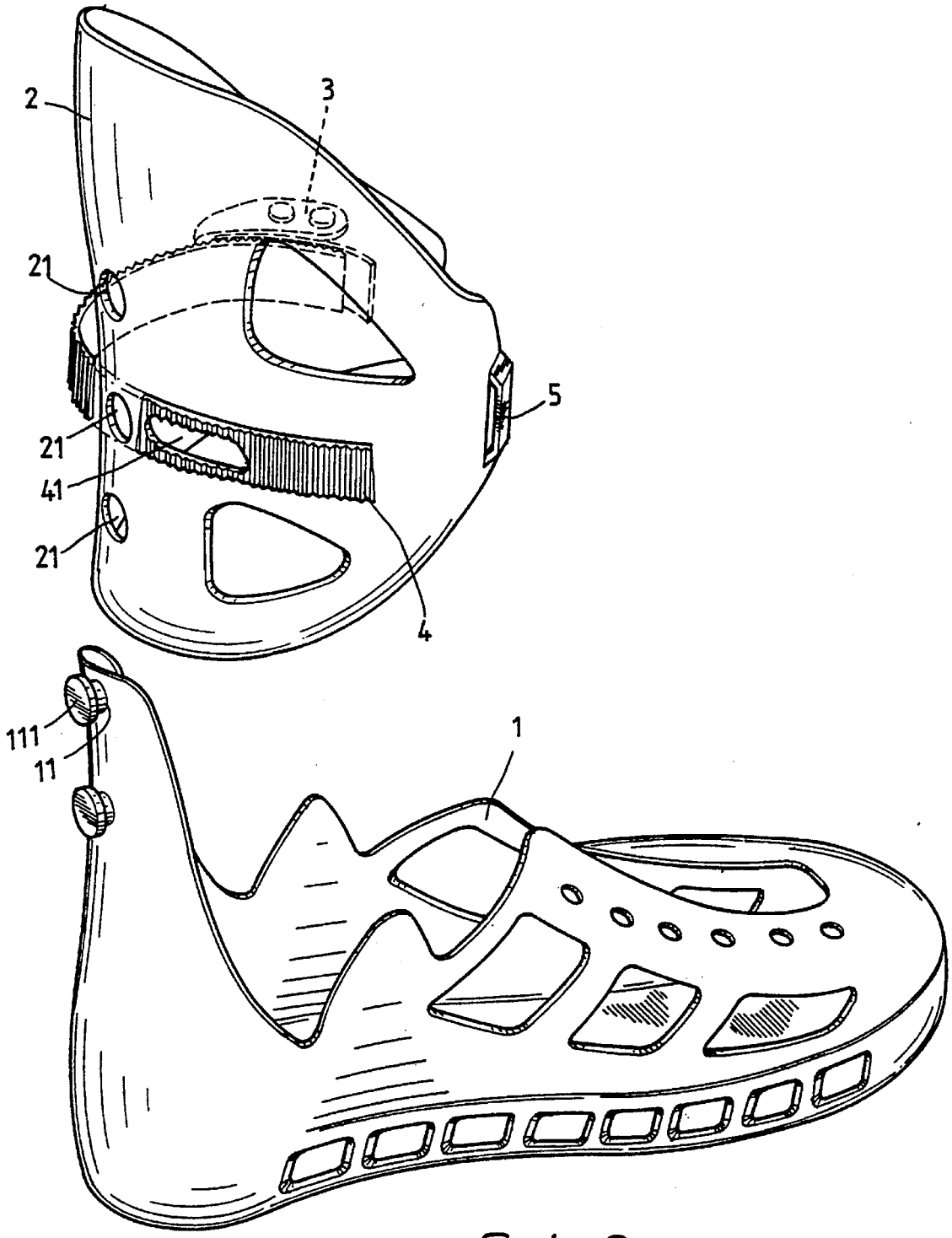
FIG. 1 is a perspective view of the present invention in which a gaiter and a shoe is disassembled.
Figure 2:
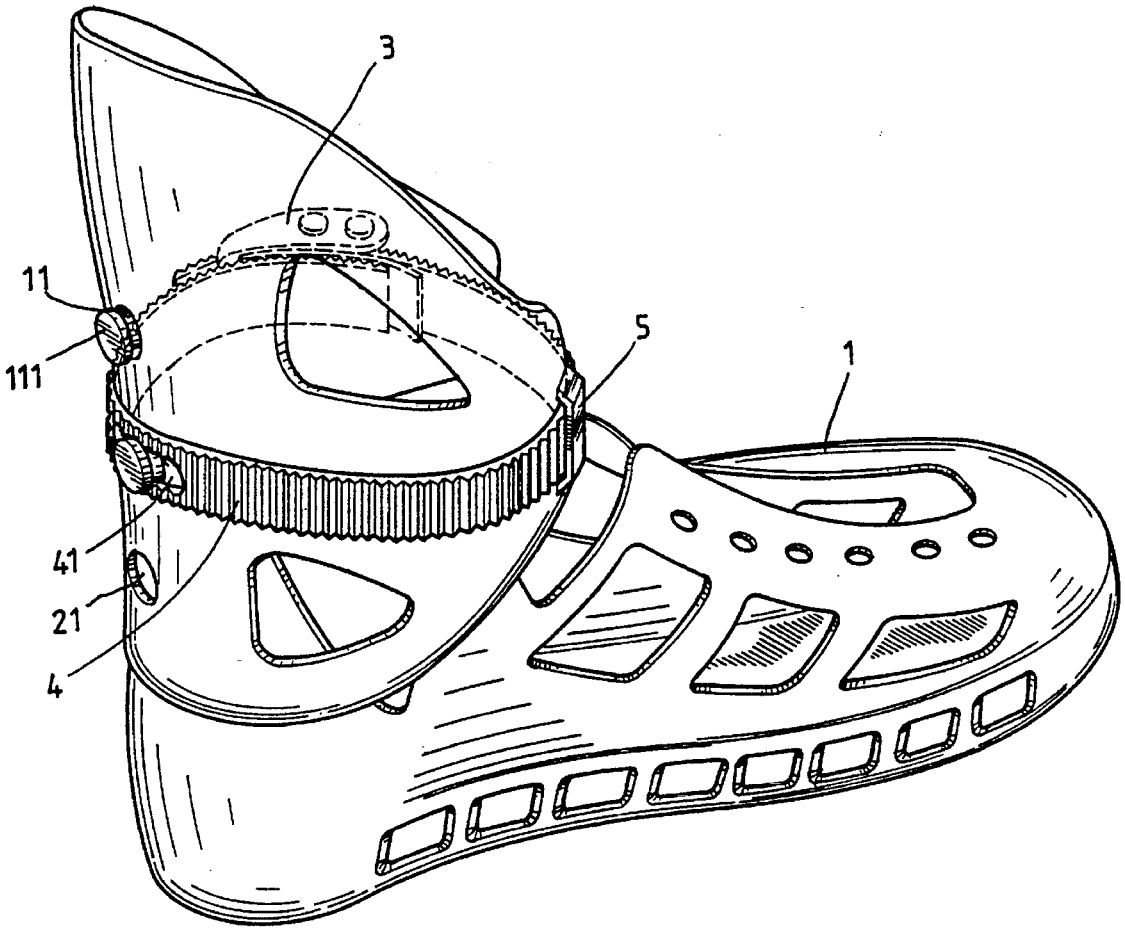
FIG. 2 is a perspective view of FIG. 1, being assembled.
Figure 3:
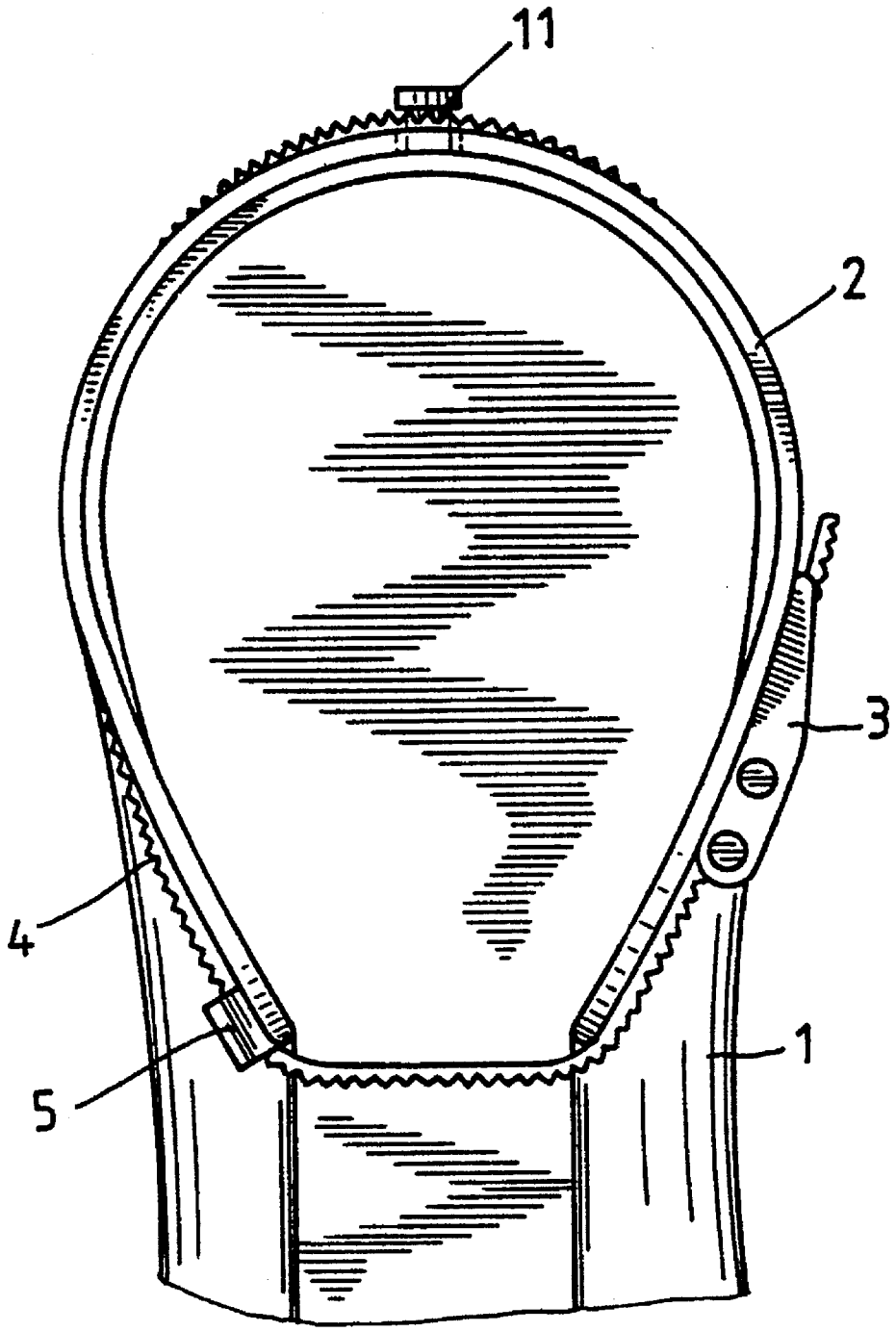
FIG. 3 is a top view of FIG. 2.

Referring now to FIG. 1 through 3, there is shown the subject gaiter and the shoe of the present invention for the purpose of illustrating a preferred embodiment only and not for the purpose of limiting the inventive concept illustrated therein. FIG. 1 includes a shoe 1 and a gaiter 2 forming the present invention. The shoe 1 includes a pair of studs 11 integrally formed to the rear end of the shoe 1 in vertical position. Each stud 11 has an enlarged head 111 at its extremity.

The gaiter 2 includes at least three apertures 21 at rear end thereof in a vertical position, a fasten belt 4 having an aperture 41 at center portion thereof in align with the center aperture 21, and a buckle 5 at one side thereof having a lateral aperture. The fasten belt 4 has one end secured to a fastener 3 and the other end of which being inserted through the aperture of the buckle 5 and secured to the fastener 3 again to form a loop to fasten the gaiter 2 to the shoe 1 in a secured manner.

To assemble the present invention, select a pair of apertures 21 that are most suitable to the user and press the gaiter 2 to force the apertures 1 passing through the enlarged portions 111 and into the studs 11. The free end of fasten belt 3 is then threaded through the aperture of the buckle 5 and secured at the fastener 3, as shown in FIG. 2. One of the enlarged portions 111 of the studs 11 at this moment will extend through the aperture 21 as well as the aperture 41 of the fasten belt 4, as shown in FIG. 3.

The three-point connection, the fastener 3, the studs 11, and the buckle 5 have enhanced the connection between the gaiter 2 and the shoe 1.

I claim:

1. A system for fastening a gaiter to a shoe, comprising:

a pair of vertically spaced studs integrally formed on a rear end portion of the shoe, each of said pair of studs having an enlarged head portion formed on a distal end thereof;

said gaiter having at least three apertures formed through a rear end portion thereof disposed in vertically spaced relation for coupling with said pair of studs by a selected adjacent pair of said three apertures, said gaiter having opposing first and second sides and a buckle integrally formed in said first side, said buckle having a vertically oriented slotted opening formed therethrough;

a fastener coupled to said second side of said gaiter; and, a belt member having a first end secured to said fastener and an opposing second end longitudinally displaced from said first end and adapted to encompass and secure said gaiter to the shoe, said belt member having a slotted through opening formed intermediate said first and second ends thereof for receipt of a lower one of said studs subsequent to said stud passing through a selected aperture of said gaiter, said second end of said belt member being adapted for passage through said vertically oriented slotted opening of said buckle and extension to said second side of said gaiter for releasable coupling with said fastener.

* * * * *